United States Patent [19]

Brega

[11] Patent Number: 4,996,853

[45] Date of Patent: Mar. 5, 1991

[54] KNITTING MACHINE WITH A DEVICE FOR ADJUSTING THE STITCH DENSITY AND FOR OFFSETTING THE STITCH CAM WITH RESPECT TO ADJACENT KNITTING CAMS

[75] Inventor: Angelo Brega, Varese, Italy

[73] Assignee: Mec-Mor S.r.l., Induno Olona, Italy

[21] Appl. No.: 369,807

[22] Filed: Jun. 22, 1989

[30] Foreign Application Priority Data

Jun. 30, 1988 [IT] Italy ..... 21172 A/88

[51] Int. Cl.[5] ..... D04B 15/32

[52] U.S. Cl. ..... 66/27

[58] Field of Search ..... 66/26, 27

[56] References Cited

U.S. PATENT DOCUMENTS

| | | | |
|---|---|---|---|
| 2,495,872 | 1/1950 | Stibbe et al. | 66/27 |
| 2,705,410 | 4/1955 | Simray et al. | 66/27 |
| 2,775,107 | 12/1956 | Shortland | 66/27 |
| 2,835,119 | 5/1958 | Wiesinger et al. | 66/26 |
| 2,850,886 | 9/1958 | Shortland | 66/27 |

FOREIGN PATENT DOCUMENTS

| | | | |
|---|---|---|---|
| 2325788 | 11/1974 | Fed. Rep. of Germany | 66/27 |
| 2654005 | 11/1976 | Fed. Rep. of Germany | 66/27 |
| 1490120 | 6/1967 | France | 66/27 |
| 1033827 | 6/1966 | United Kingdom | 66/27 |

*Primary Examiner*—Werner H. Schroeder
*Assistant Examiner*—John J. Calvert
*Attorney, Agent, or Firm*—Guido Modiano; Albert Josif

[57] ABSTRACT

This knitting machines includes a device for adjusting the stitch density and for offsetting the stitch cam with respect to adjacent knitting cams. The device comprises a stitch cam associated with a knitting cam supporting structure which is arranged facing a needle supporting element and is movable relatively thereto actuate the needles by means of the knitting cams. The stitch cam is controllably movable relatively to the knitting cam supporting structure along a direction which is substantially parallel to the axis of the engaged needles. The stitch cam is furthermore controllably movable relatively to the knitting cam supporting structure along a direction which is substantially parallel to the tangent to the path of the knitting cam supporting structure in the motion relative to the needle supporting element to anticipate or delay the engagement of the stitch cam with the needles.

20 Claims, 4 Drawing Sheets

KNITTING MACHINE WITH A DEVICE FOR ADJUSTING THE STITCH DENSITY AND FOR OFFSETTING THE STITCH CAM WITH RESPECT TO ADJACENT KNITTING CAMS

BACKGROUND OF THE INVENTION

The present invention relates to a knitting machine with a device for adjusting the stitch density and for offsetting the stitch cam with respect to adjacent knitting cams.

As is known, knitting machines, sock- and stocking-making machines and the like comprise a needle supporting element constituted, in circular machines, by a cylinder with a plurality of grooves defined along its directrices, in which the needles are accommodated and can slide axially; said needles have at least one heel protruding from said grooves to engage within paths defined by a plurality of shaped cams mounted on a supporting structure and arranged facing the needle supporting element. In circular machines with two needle beds there are two needle supporting elements, since a dial its arranged above the cylinder and has radial grooves in which other needles are accommodated and face the needles carried by the cylinder. The needles of the dial also have at least one heel which protrudes upwardly from the grooves of the dial and engages within paths defined by other cams mounted on a supporting structure arranged upwardly facing the dial. The relative motion between the supporting structures of the cams and the respective needle supporting elment causes the needles to follow the paths defined by the cams, moving the needles along the respective grooves to grip the thread fed by the thread guides and to form stitches. In circular machines said relative motion occurs about the axis of the machine, which coincides with the axis of the cylinder and with the axis of the dial.

Among the various knitting cams, the stitch cams are those which lower the needles of the cylinder or move the needles of the dial toward the axis of the dial after said needles have engaged the thread fed by a thread guide, casting off the previously formed stitches.

In order to adjust the knitting tightness, the stitch cams are controllably movable with respect to their supporting structure in a direction which is parallel to the axis of the needles which engage in each instance with said stitch cam. The stitch cams of the dial are movable in a radial direction with respect to the dial, while the stitch cams of the cylinder are movable in a direction which is parallel to the axis of the cylinder. By moving the stitch cams the length of the loops formed by the needles is changed and the obtainable stitch density is therefore varied.

For special knittings, in some case an anticipated or delayed offset of the stitch cams is required with respect to the needles. In cylinder and dial machines this operation is generally performed on the cams which act on the needles of the dial, offsetting the entire supporting structure of the dial cams with respect to the dial itself by a preset angle.

The operation of offsetting the supporting structure of the dial cams is generally performed manually or by means of mechanical actuators.

Besides obtaining the required change in the position of the stitch cams, offsetting the entire cam supporting structure also causes the offset of all the knitting cams, involving problems with regard to other kinds of knitting, for which a different position of the other knitting cams would be preferable. For example, in cylinder and dial machines the offset of the other knitting cams with respect to the original position may cause problems in knittings which require a transfer of the stitch from needles of the cylinder to needles of the dial or vice versa.

In multiple-feed machines, the offset of the entire knitting cam supporting structure furthermore causes the offset of the knitting cams of all the feeds and not only of the cams which act on the needles which must engage the thread at a specific feed and for which said offset is acutually required.

SUMMARY OF THE INVENTION

The aim of the present invention is to solve the above described problems by providing a knitting machine with a device which allows the stitch cams to be offset with respect to adjacent knitting cams without involving, in said offset, knitting cams which should preferably keep their position unchanged due to other requirements.

Within this aim, an object of the invention is to provide a device which besides providing this offset also allows to adjust the stitch density.

Another object of the invention is to provide a device which can be actuated automatically by a machine control element which supervises the various operations.

Not least object of the invention is to provide a device which is simple and requires modest dimensions for its installation.

This aim, as well as these and other objects which will become apparent hereinafter, are achieved by a knitting machine with a device for adjusting stitch density and for offsetting a stitch cam with respect to adjacent knitting cams, as defined in the appended claims.

BRIEF DESCRIPTION OF THE DRAWINGS

The characteristics and advantages of the invention will become apparent from the detailed description of a preferred but not exclusive embodiment of the device according to the invention, illustrated only by way of non-limitative example in the accompanying drawings, in its application to a dial of a circular machine of the cylinder and dial type, wherein.

DESCRIPTION OF THE PREFERRED EMBODIMENTS

Figure 11:
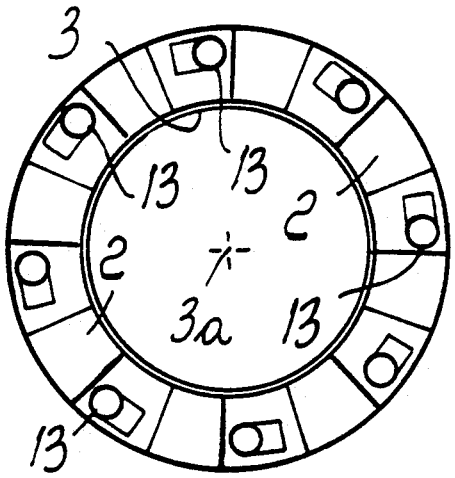
FIG. 11 is a schematic plan view, in reduced scale, of a dial of a knitting machine with devices according to the invention.

With reference to the above described figures, the device according to the invention, generally indicated by the reference numeral 1, which as mentioned is illustrated n its application to the dial of a cylinder and dial circular knitting machine with two needle beds, comprises a knitting cam supporting structure 2 which is arranged facing a needle supporting element 3 indeed comprising, in the illustrated case, the dial, which has a plurality of radial grooves each whereof accommodates a needle 4 in a known manner; each needle 4 protrudes above the dial 3 with a heel 4*a* so as to engage with the paths defined by the knitting cams. p As in known machines, the supporting structure 2 is movable relatively to the supporting element so that the heels 4*a* move along the paths defined by the knitting cams. In the illustrated case the dial 3 can be rotatably actuated about its own axis 3*a* (FIG. 11) with respect to the supporting structure 2 which remains fixed, or vice versa.

A stitch cam 5 is mounted on the supporting structure 2 such that the stitch cam surface 5*a* is arranged facing the needle supporting element 3. The stitch cam 5 is controllably movable along a direction 6 which is parallel to the axis of the needles 4 which in that moment engage therewith to vary the stitch density; according to the invention, said cam 5 is further controllably movable, with respect to the supporting structure 2, along an actuation direction 7 which is substantially parallel to the tangent to the path defined by the supporting structure 2 in its motion relatively to the needle supporting element 3, i.e. to the dial, to provide an anticipated or delayed offset of the stitch cam with respect to adjacent knitting cams. Thus it is seen that the stitch cam 5 is controllably movable along the direction 6 which is parallel to the axis of the needles and it is also controllably movable along the direction 7 which is perpendicular to the direction 6, such directions 6 and 7 both lying in a stitch cam plane define by the stitch cam surface 5*a*.

The device according to the invention conveniently comprises a first slider 8 which is accommodated in a first guide 9 defined in the supporting structure 2 and is slidable in a direction which is parallel to the actuation direction 7 and a second slider 10 which is rigidly associated with the stitch cam 5 and is accommodated in a second guide 11 defined in the first slider 8 and is slidable in a direction which is substantially parallel to the axis of the needles which are engaged in each instance with the stitch cam; in practice the two guides 9 and 11 are perpendicular to one another.

Figure 4:
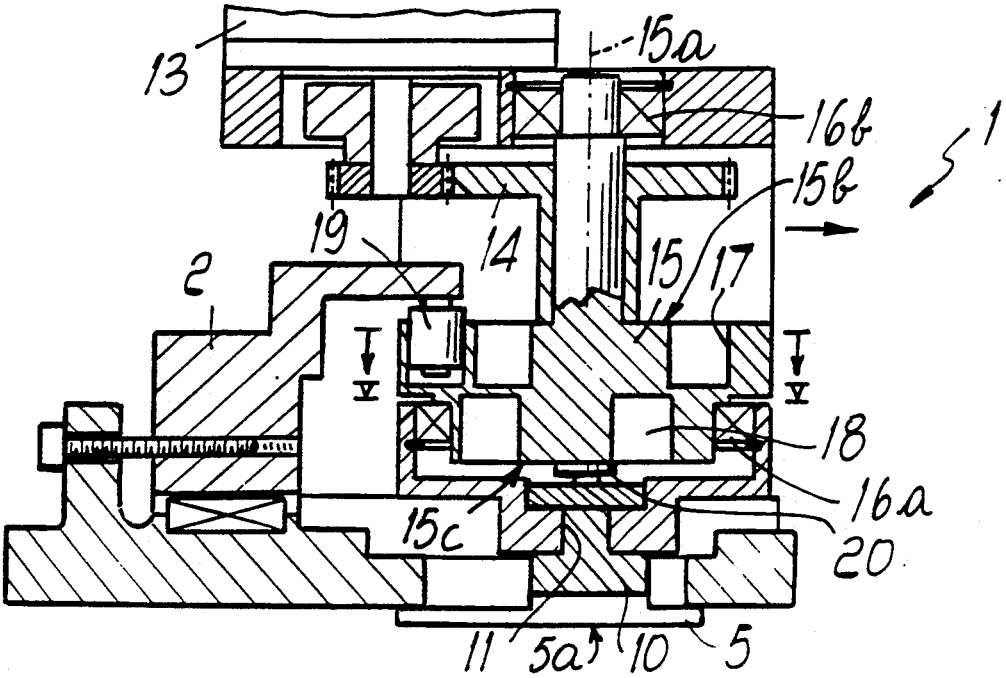
FIG. 4 is a view of the device, similar to FIG. 1, with the stitch cam arranged offset.
Figure 5:
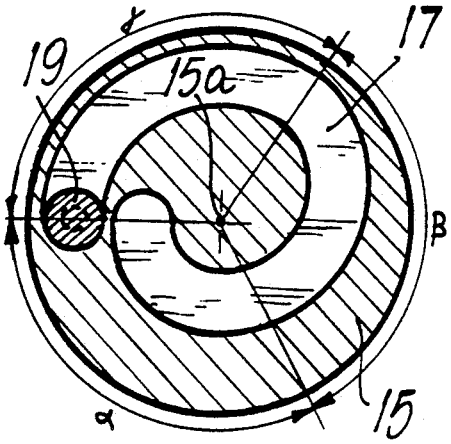
FIG. 5 is a sectional view of FIG. 4, taken along the axis V—V.

Actuation means 12 act on the stitch cam 5 and move it along the two directions 6 and 7. Said actuation means advantageously comprises a single actuator element which acts both on the first slider 8 and on the second slider 10 to controllably move said sliders along the directions 6 and 7. The actuator element comprises a step motor 13 which has its output shaft 13*a* connected, through a reducer 14, to a two-profile cam 15 which is rotatably supported about its own axis 15*a* by the first slider 8 by means of two pairs of bearings 16*a* and 16*b*. The two-profile cam 15 is substantially disk-shaped and has, respectively on it two faces 15*b* and 15*c* (FIG. 4), two recessed profiles 17 and 18 with portions which are eccentric with respect to the axis 15*a*; a first cam follower element 19 and a second cam follower element 20 are engaged in said profiles and are operatively connected respectively to the first slider 8 and to the second slider 10.

Figure 9:
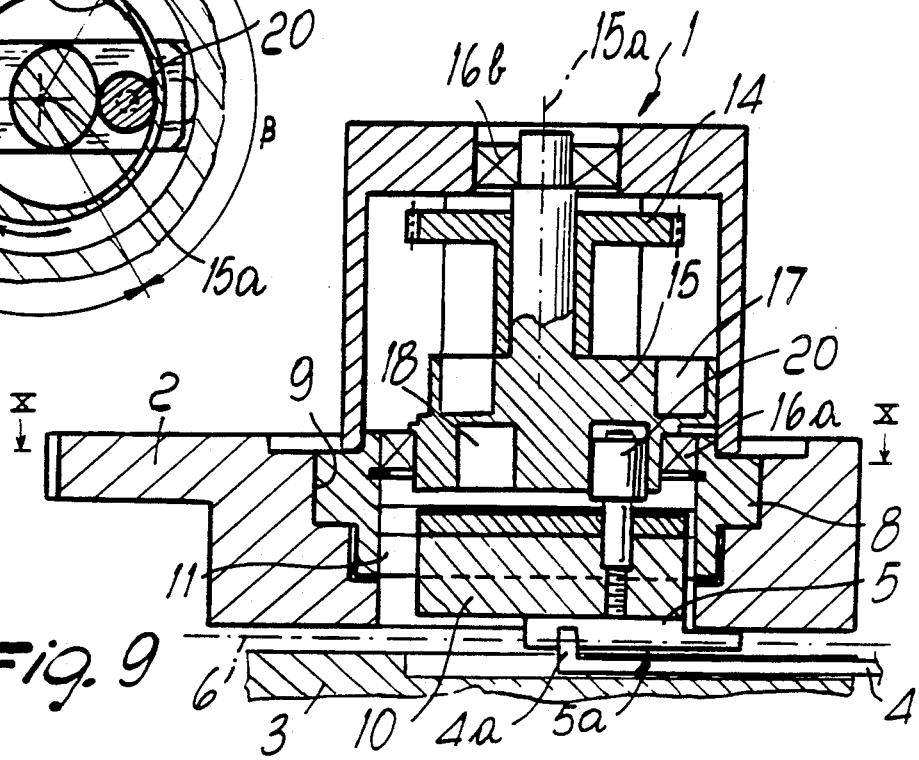
FIG. 9 is a sectional view of FIG. 8 taken along the axis IX—IX.
Figure 8:
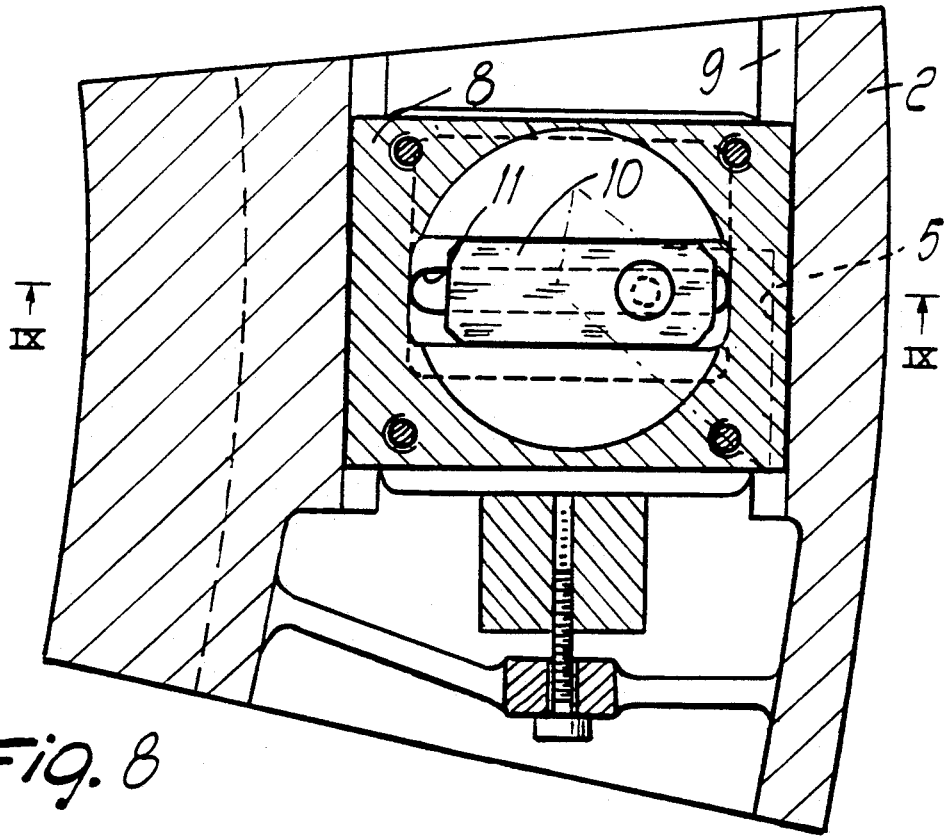
FIG. 8 is a sectional view, similar to FIG. 2, with the stitch cam shifted parallel to the axis of the needles which engage it in each instance.

More particularly, the first and second cam follower elements comprise wheels, with the second cam follower element 20 being supported by the second slider 10 so as to be rotatable about its axis (see FIG. 9) and first cam follower element 19 being supported by the supporting structure 2, so as to be rotatable about its axis, while the two-profile cam 15 with the step motor 13 is rigidly associated with the first slider 8 in its motion along the actuation direction 7.

Figure 1:
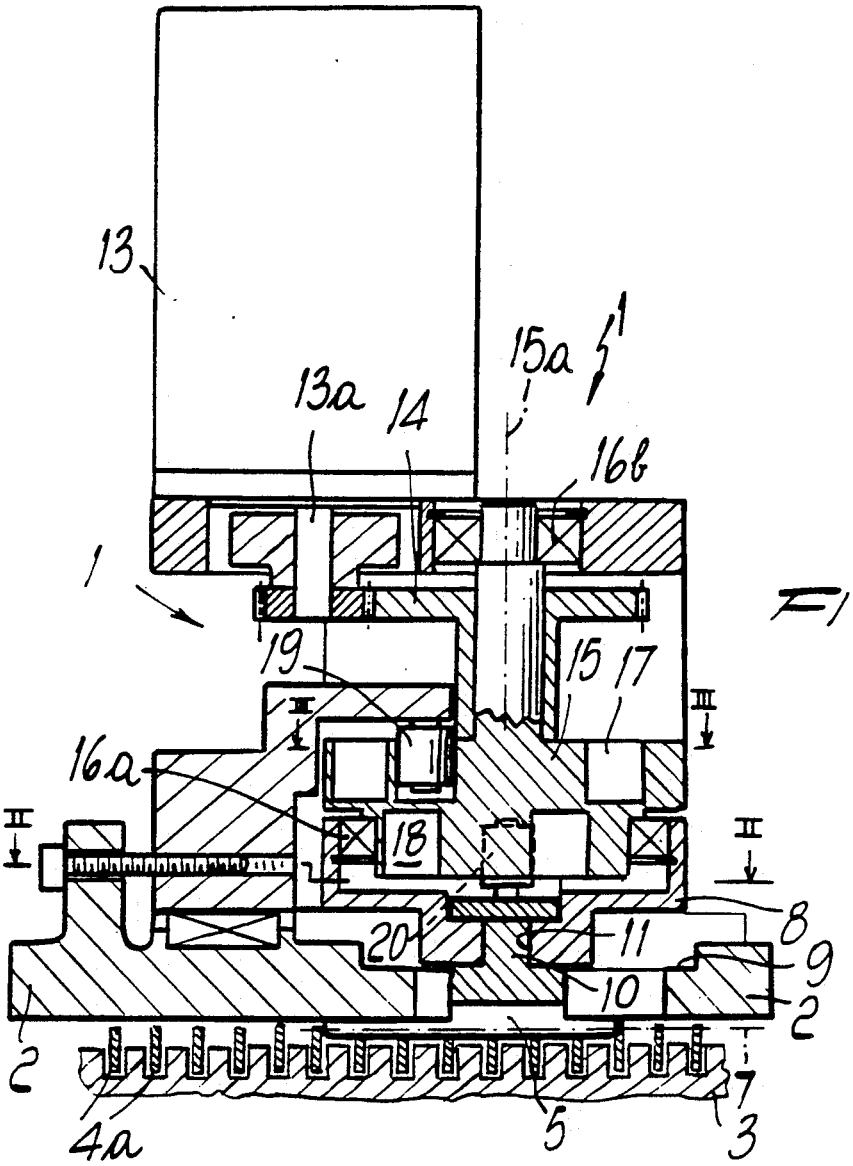
FIG. 1 is a partially sectional lateral elevation view of the device according to the invention, seen radially from the outside.
Figure 3:
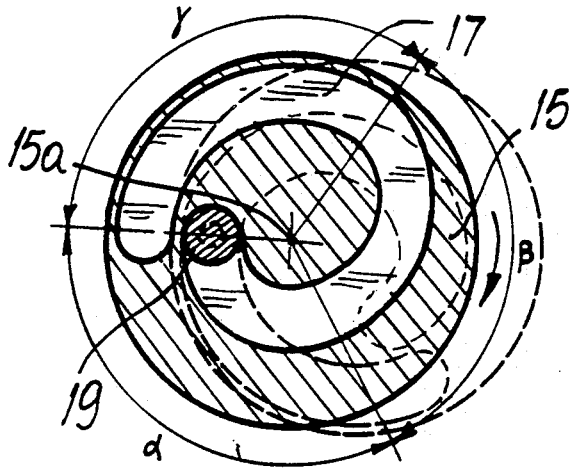
FIG. 3 is a sectional view of a FIG. 1 taken along the axis III—III.
Figure 7:
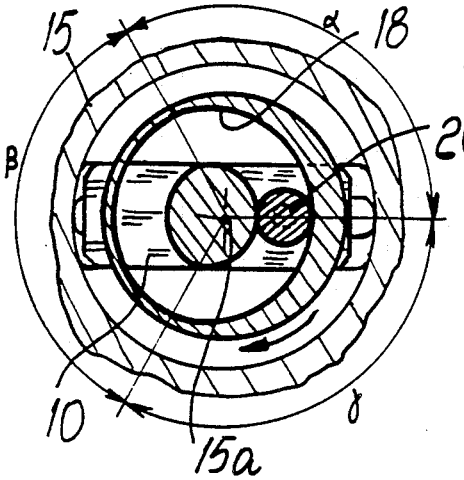
FIG. 7 is a sectional view of FIG. 6, taken along the axis of VII—VII.
Figure 6:
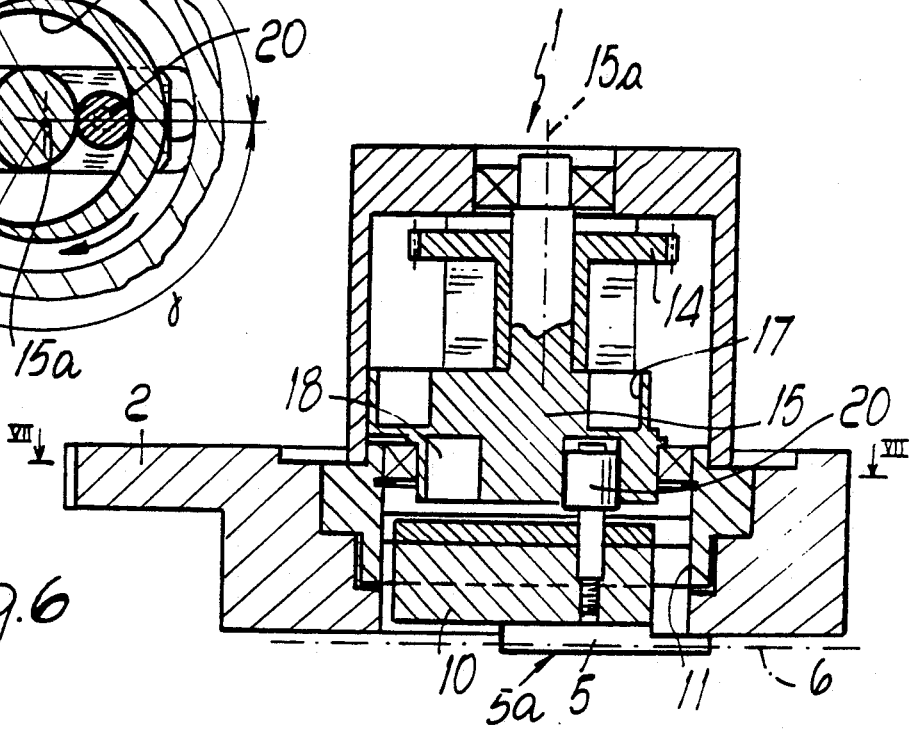
FIG. 6 is a sectional view of FIG. 2, taken along the axis VI—VI.
Figure 2:
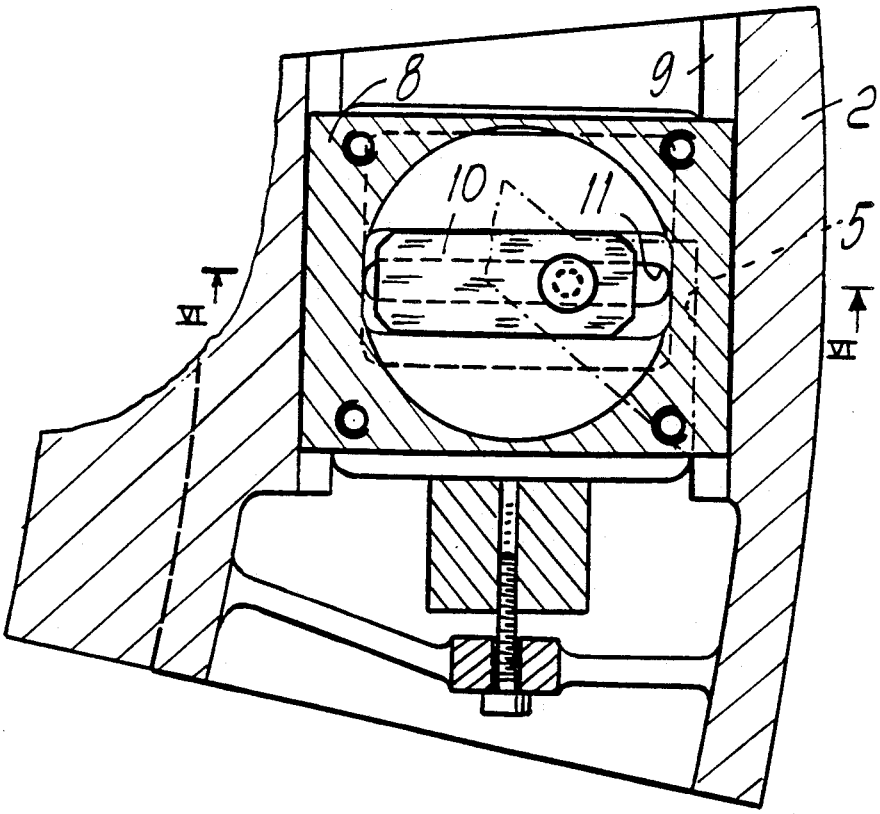
FIG. 2 is a sectional view of FIG. 1 taken along the axis II—II.
Figure 10:
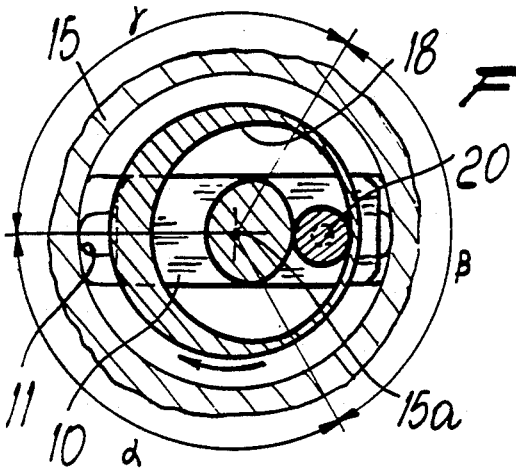
FIG. 10 is a sectional view of FIG. 9, taken along the axis X—X.

Each of the profiles 17 and 18 has eccentric portions along center angles which are different and not overlying in the two profiles. More particularly, let's consider center angles on the two faces of the two-profile cam 15 starting from an idle or zero position, occupied by the cam-follower elements 19 and 20 (FIGS. 3 and 7): for a center angle $\alpha$, the first profile 17 is concentric to the axis 15*a* of the actuation cam 15, while the second profile 18 is eccentric and leads away from the axis 15*a*; for an angle $\beta$ successive to $\alpha$, the first profile 17 defines an eccentric path leading away from the axis 15*a*, while the second profile 18 defines a path which is concentric to said axis; for an angle $\gamma$ successive to $\beta$, the first profile 17 again defines a path which is concentric to the axis 15*a*, while the second profile 18 defines a eccentric path leading towards the axis 15*a*.

The operation of the device according to the invention is as follows.

If the stitch density is to be changed without offsetting the stitch cam 5, the step motor 13 is actuated to impact a partial rotation to the two-profile cam 15 about its axis 15*a* according to an angle which is smaller or at the most equal to the angle $\alpha$. In this manner the second cam-follower element 20 follows an eccentric portion of the profile 18, varying the position of the stitch cam 5 along the direction 6, while the first cam-follower element 19 follows a concentric portion of the first profile 17 and therefore does not move the first slider along the direction 7.

If the stitch density is to be changed with an offset of the stitch cam 5, the step motor 13 is actuated to impart a partial rotation to the two-profile cam 15 about its own axis 15*a* according to an angle which is greater than $\alpha+\beta$. In this manner, while the first cam-follower element 19 follows the eccentric portion of the first profile 17 corresponding to the angle $\beta$, since the cam-follower element 19 is mounted on the supporting structure 2 and the cam-follower element 20 follows a path portion which is concentric to axis 15*a*, the first slider and the second slider rigidly move along the direction 7. Once the rotation through an angle $\alpha+\beta$ has ended, the further rotation of the two-profile can 15 moves exclusively the second slider 10 and therefore the stitch cam 5 which respect to the first slider along the direction 6 according to the required variation in the stitch density.

In practice it has been observed that the device according to the invention fully achieves the intended aim, since it allows to obtain an anticipated or delayed offset of the stitch cam with respect to adjacent knitting cams without involving the other knitting cams in said offset.

Another advantage resides in the fact that it achieves, by means of a single actuator, an adjustment of the stitch density and the offset of the stitch cam. This fact extremely simplifies the connections of the actuator to the generally electronic control element which supervises the various operations of the machine during knitting.

Though the device has been conceived in particular to be mounted on the dial of a circular knitting machine with two needle beds, i.e. of the cylinder and a dial type, it may be in any case mounted on the supporting structure of the cylinder cams or be advantageously used in circular machines with a single needle bed, i.e. having only the cylinder, or in flat knitting machines.

The device thus conceived is susceptible to numerous modifications and variations, all of which are within the scope of the inventive concept; all the details may be furthermore replaced with technically equivalent elements.

In practice, the materials employed, as well as the dimensions, may be any according to the requirements and to the state of the art.

I claim:

1. In a knitting machine, a device for adjusting stitch density and for offsetting a stitch cam with respect to adjacent knitting cams, comprising a plurality of needles having each a needle axis, a needle supporting element, cam assemblies including a stitch cam defining a stitch cam plane, a cam supporting structure arranged facing said needle supporting element and movable relatively thereto along a path to actuate said needles by means of said cam assemblies, said stitch cam being controllably movable relatively to said cam supporting structure along a first direction which is substantially parallel to the axis of the needles engaged by said stitch cam and which lies in said stitch cam plane, said stitch cam being controllably movable relatively to said cam supporting structure along an actuation direction which is substantially perpendicular to said first direction and which lies in said stitch cam plane, actuation means acting on said stitch cam to move it along said actuation direction to anticipate or delay engagement of said stitch cam with said needles, said device further comprising a first slider coupled to a first guide defined in said cam supporting structure and actuated by said actuation means so as to slide in a direction substantially parallel to said actuation direction, and a second slider rigidly associated with said stitch cam and associated with said first slider so as to slide along a direction which is substantially parallel to the axis of the needles engaged by said stitch cam, said actuation means comprising a two-profile cam rotating around a rotation axis and having two profiles with portions which are eccentric to said rotation axis, said two-profile cam being actuatable with a rotary motion according to angles of preset amplitude, said profiles being respectively coupled with a first and a second cam-follower element operatively connected respectively to said first and to second sliders to move them, said second cam-follower element being supported by said second slider.

2. A device according to claim 1, wherein said first cam follower element is supported by said cam supporting structure, said two-profile cam being rotatably supported about said rotation axis by said first slider and being rigidly associated therewith in a motion along said actuation direction.

3. A device according to claim 1, wherein said two-profile cam is rotatably supported about said rotation axis by said first slider by means of bearings means, said two-profile cam being actuated by a step motor mounted on said first slider on a side of said first slider opposite to said stitching cam, said step motor having an output shaft drivably connected to the two-profile cam through a reducer.

4. A device according to claim 1, wherein said two-profile cam comprises a disk having two faces, each face defining a recessed path with portions which are eccentric with respect to said rotation axis.

5. A device according to claim 4, wherein said profiles of said two-profile cam have eccentric portions at mutually different angular positions.

6. A device according to claim 1, wherein said needle supporting element defines a needle cylinder in a circular knitting machine.

7. A device according to claim 1, wherein said needle supporting element defines a dial of a circular cylinder and dial knitting machine.

8. In a knitting machine, a device for adjusting stitch density and for offsetting a stitch cam with respect to adjacent knitting cams, comprising a plurality of needles having each a needle axis, a needle supporting element, cam asemblies including a stitch cam defining a stitch cam plane, a cam supporting structure arranged facing said needle supporting element and movable relatively thereto along a path to actuate said needles by means of said cam assemblies, said stitch cam being controllably movable relatively to said cam supporting structure along a first direction which is substantially parallel to the axis of the needles engaged by said stitch cam and which lies in said stitch cam plane, said stitch cam being controllably movable relatively to said cam supporting structure along an actuation direction which is substantially perpendicular to said first direction and which lies in said stitch cam plane, actuation means acting on said stitch cam to move it along said actuation direction to anticipate or delay engagement of said stitch cam with said needles, said device further comprising a first slider coupled to a first guide defined in said cam supporting structure and actuated by said actuatioin means so as to slide in a direction substantially parallel to said actuation direction, and a second slider rigidly associated with said stitch cam and associated with said first slider so as to slide along a direction which is substantially parallel to the axis of the needles engaged by said stitch cam, said actuation means comprising a two-profile cam rotating around a rotation axis and having two profiles with portions which are eccentric to said rotation axis, said two-profile cam being actuatable with a rotary motion according to angles of preset amplitude, said profiles being respectively coupled with a first and a second cam-follower element operatively connected respectively to said first and to second sliders to move them, said two-profile cam comprising a disk having two faces, each face defining a recessed path with portions which are eccentric with respect to said rotation axis, said profiles of said two-profile cam having eccentric portions at mutually different angular positions.

9. A device according to claim 8, wherein said second cam-follower element is supported by said second slider.

10. A device according to claim 8, wherein said first cam follower element is supported by said cam supporting structure, said two-profile cam being rotatably supported about said rotation axis by said first slider and being rigidly associated therewith in a motion along said actuation direction.

11. A device according to claim 8, wherein said two-profile cam is rotatably supported about said rotation axis by said first slider by means of bearings means, said two-profile cam being actuated by a step motor mounted on said first slider on a side of said first slider opposite to said stitching cam, said step motor having an output shaft drivably connected to the two-profile cam through a reducer.

12. A device according to claim 8, wherein said needle supporting element defines a needle cylinder in a circular knitting machine.

13. A device according to claim 8, wherein said needle supporting element defines a dial of a circular cylinder and dial knitting machine.

14. In combination, a knitting machine and a device for adjusting stitch density and for offsetting the stitch cam with respect to the adjacent knitting cams, said knitting machine comprising a needle supporting element which slidably supports a plurality of needles each having a needle axis and a needle heel, and a cam supporting structure which supports cam assemblies including knitting cams and at least one stitch cam, said cam supporting structure being arranged facing said needle supporting element and being movable relatively thereto such that said needles are slidably actuated to knit by means of said knitting cams engaging with said needle heels, said stitch cam defining a stitch cam plane facing said needle supporting element, said stitch cam being controllably movable relative to said cam supporting structure along a first direction which is substantially parallel to the axis of said needles engaged by said stitch cam and which lies in said stitch cam plane, said stitch cam being controllably movable relative to said cam supporting structure along an actuation direction which is substantially perpendicular to said first direction and which lies in said stitch cam plane, said device comprising actuation means acting on said stitch cam to move said stitch cam along said first direction in order to adjust the stitch density, said actuation means also acting on said stitch cam to move said stitch cam along said actuation directioin to offset said stitch cam with respect to adjacent said knitting cams in order to adjust the time of engagement of said stitch cam with said needles.

15. A combination according to claim 14, wherein said device further comprises a first slider slidingly coupled to a first guide defined in said cam supporting structure and a second slider rigidly supporting said stitch cam, said second slider being slidingly coupled to a second guide defined in said first slider, said first guide having a longitudinal extension substantially parallel to said actuation direction and said second guide having an extension substantially parallel to said first direction, said first slider being actuated by said actuation means to slidingly move said first slider in said first guide, said second slider being actuated by said actuation means to slidingly move said secodn slider in said second guide.

16. A combination according to claim 15, wherein said actuation means comprise a two-profile disk-like cam defining a first face and a second face and a rotation axis being perpendicular to said first face and said second face, said two-profile cam being rotatable about said rotation axis, said first face having a first recessed profile with a first portion which is eccentric to said rotation axis, said second face having a second recessed profile with a second portion which is eccentric to said rotation axis, said actuation means further comprising a first cam follower element engageably coupled in said first recessed profile and a second cam follower element engageably coupled in said second recessed profile, said first cam follower element being operatively connected to said first slider, said second cam follower element being operatively connected to said second slider.

17. A combination accordng to claim 15, wherein said actuation means comprise a two-profile disk-like cam defining a first face and a second face and a rotation axis being perpendicular to said first face and said second face, said two-profile cam being rotatable about said rotation axis, said first face having a first recessed profile with a first portion which is eccentric to said rotation axis, said second face having a second recessed profile with a second portion which is eccentric to said rotation axis, said actuation means further comprising a first cam follower element engageably coupled in said first recessed profile and a second cam follower element engageably coupled in said second recessed profile, said first cam follower element being operatively connected to said first slider, said second cam follower element being operatively connected to said second slider, said two-profile cam being rotatably supported about said rotation axis by said first slider by means of bearing means, said two-profile cam being actuatable with a rotary motion according to angles of preset amplitude by a step motor mounted on said first slider on a side of said first slider opposite to said stitching cam, said step motor having an output shaft drivably connected to said two-profile cam through a reducer.

18. A combination according to claim 15, wherein said actuation means comprise a two-profile disk-like cam defining a first face and a second face and a rotation axis being perpendicular to said first face and said second face, said two-profile cam beign rotatable about said rotation axis, said first face having a first recessed profile with a first portion which is eccentric to said rotation axis, said second face having a second recessed profile with a second portion which is eccentric to said rotation axis, said actuation means further comprising a first cam follower element engageably coupled in said first recessed profile and a second cam follower element engageably coupled in said second recessed profile, said first cam follower element being operatively connected to said first slider, said second cam follower element being operatively connected to said second slider, said profiles of said two-profile cam having eccentric portions at mutually different angular positions.

19. A combination according to claim 14, wherein said needle supporting element is a needled cylinder in a circular knitting machine.

20. A combination according to claim 14, wherein said needle supporting element is a dial of a circular cylinder and dial knitting machine.

* * * * *